US007510102B2

(12) United States Patent
Schmitt

(10) Patent No.: US 7,510,102 B2
(45) Date of Patent: Mar. 31, 2009

(54) CLOG RESISTANT ACTUATOR AND OVERCAP

(76) Inventor: William H. Schmitt, 103 Linden Ave., Branford, CT (US) 06405

( * ) Notice: Subject to any disclaimer, the term of this patent is extended or adjusted under 35 U.S.C. 154(b) by 558 days.

(21) Appl. No.: 11/359,627

(22) Filed: Feb. 22, 2006

(65) Prior Publication Data

US 2007/0194049 A1 Aug. 23, 2007

(51) Int. Cl.
*B67D 1/08* (2006.01)

(52) U.S. Cl. ..... 222/148; 220/284

(58) Field of Classification Search ..... 222/148, 222/402.13, 562, 151, 402.15, 402.23, 182, 222/183; 239/106, 114, 115, 123, 601; 220/266, 220/915, 284

See application file for complete search history.

(56) References Cited

U.S. PATENT DOCUMENTS 3,565,295 A * 2/1971 Doyle ..... 222/182
3,589,570 A * 6/1971 Gach ..... 222/402.13
3,804,286 A * 4/1974 Watson et al. ..... 220/284
4,130,220 A * 12/1978 McKirnan ..... 220/284
4,135,638 A * 1/1979 Wandl ..... 220/284
5,105,988 A * 4/1992 Knickerbocker ..... 222/148
5,207,785 A * 5/1993 Knickerbocker ..... 222/148
5,632,393 A * 5/1997 Houser ..... 220/277
6,158,625 A * 12/2000 Siegel et al. ..... 222/148
6,223,951 B1 * 5/2001 Siegel et al. ..... 222/148
6,257,451 B1 * 7/2001 Siegel et al. ..... 222/148

* cited by examiner

*Primary Examiner*—George Nguyen
*Assistant Examiner*—Michael Hagedorn

(57) ABSTRACT

An aerosol dispenser utilizes a vertical container filled with a pressurized liquid. An actuator which has a nozzle is positioned on the valve stem which is located on the top of the container. The actuator when pressed vertically or horizontally allows a jet flow of liquid to spray from the nozzle. The dispenser is provided with apparatus for preventing formation of a residual liquid film after termination of the jet flow spray which would otherwise clog the nozzle.

5 Claims, 1 Drawing Sheet

FIG. 1
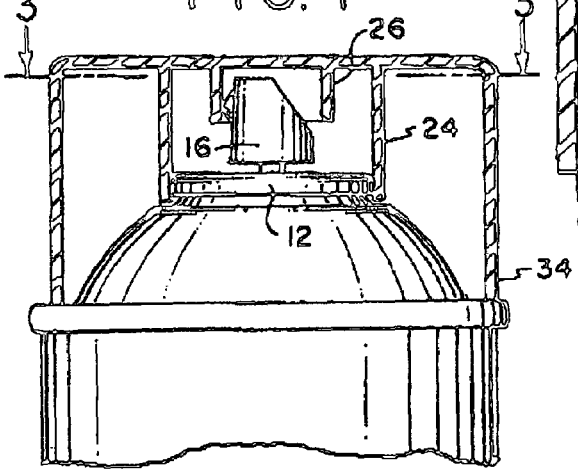
FIG. 2
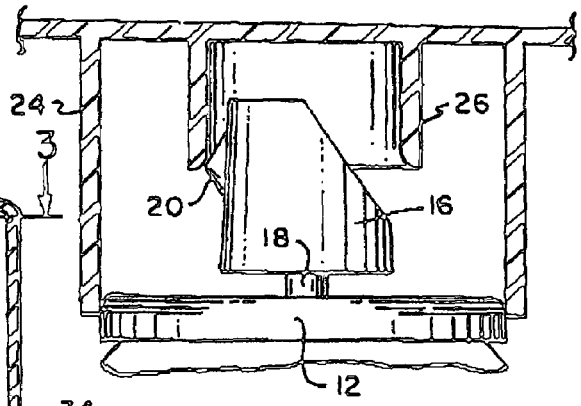
FIG. 4
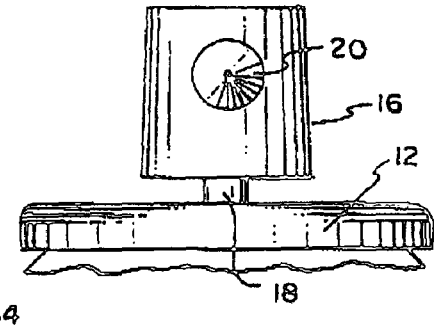
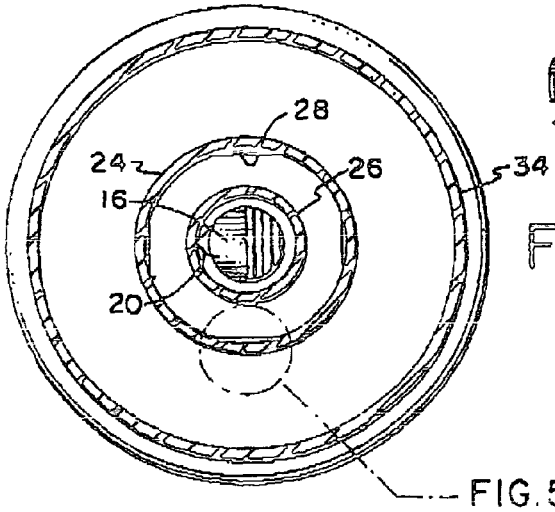
FIG. 3
FIG. 5
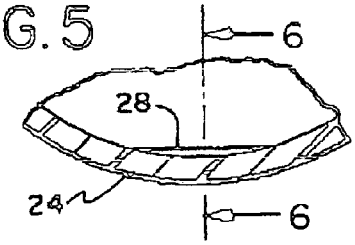
FIG. 6
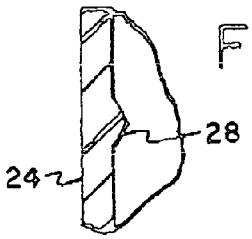

CLOG RESISTANT ACTUATOR AND OVERCAP

FIELD OF THE INVENTION

This invention relates to design improvements for aerosol dispensers.

BACKGROUND OF THE INVENTION

An aerosol dispenser employs a vertical container filled with pressurized liquid. An actuator is positioned on the valve stem which is located on the top of the container and part of the overall valve components. The actuator is used to dispense the product and consists of internal channels and an orifice to allow product application. The valve stem may be vertically or horizontally actuated depending on the internal valve design. The valve stem is inserted into a valve housing which is attached to a valve cup. The valve cup is crimped to the container and forms the primary seal to the package. The valve housing is designed with internal channels to allow material that is in the container to be feed up through a dip tube into the valve housing. Moving the actuator in accordance with the valve design moves the sealing surface of the valve stem from a sealing gasket located in the valve housing. This action allows the pressurized materials to flow out of the valve stem and into the actuator. The actuator will then dispense the pressurized materials from the container. Removal of actuation pressure will allow the valve to return to its normal sealed position and will stop the flow of materials out the actuator. In certain types of products with insoluble or high levels of materials or film formers there can be a build up of residual liquid that dries into a clogging film in and over the actuator orifice. This film must be removed before the dispenser can be reused and sprayed with a desired spray pattern and droplet size. The partial clog usually results in an imperfect spray pattern or stream, while a full clog will prevent spraying altogether. Typically, the film is removed by rinsing with water or by wiping manually. The present invention discloses apparatus for automatically removing the film, thus preventing clogging.

SUMMARY OF THE INVENTION

In accordance with the principles of this invention, an aerosol dispenser is provided with a vertical container filled with a pressurized liquid. An actuator is positioned on the valve stem which is located on the top of the container and part of the overall valve components. The actuator is used to dispense the product and consists of internal channels and an orifice to allow product application. The valve stem may be vertically or horizontally actuated depending on the internal valve design. The valve stem is inserted into a valve housing, which is attached to a valve cup, the valve cup is crimped to the container and forms the primary seal to the package. The valve housing is designed with internal channels to allow material that is in the container to be feed up through a dip tube into the valve housing. Moving the actuator in accordance with the valve design moves the sealing surface of the valve stem from a sealing gasket located in the valve housing. This action allows the pressurized materials to flow out of the valve stem and into the actuator. The actuator will then dispense the pressurized materials from the container. Removal of actuation pressure will allow the valve to return to its normal sealed position and will stop the flow of materials out of the actuator. In certain types of products with insoluble or high levels of materials or film formers there can be a build up of residual liquid that dries into a clogging film in and over the actuator orifice. This film when significant must be removed before the dispenser can be reused and sprayed with a desired spray pattern and droplet size. The partial clog usually results in an imperfect spray pattern or stream, while a full clog will prevent spraying altogether. Typically, the film is removed by rinsing with water or by wiping manually.

In this invention, apparatus is provided for film removal. This apparatus includes: first a typical aerosol overcap which normally attaches to the external surface of the valve cup with an internal sealing cup around the actuator. This cap has been modified with a second vertical cap which encloses the actuator, and with a third and smaller vertical cap that is designed to seal and wipe the actuator. When the cap is placed on the package this internal third cup will slide over the actuator orifice and wipe material that may be present on the orifice and can also seal the surface to reduce drying out of materials in the orifice. These and other objects and advantages of this invention will either be explained or will become apparent hereinafter.

BRIEF DESCRIPTION OF THE DRAWINGS

FIG. 1 is a vertical cross sectional view of the invention.

FIG. 2 is a detail cross sectional view illustrating the action of the first and second caps in film removal.

FIG. 3 is a view taken along line 3-3 in FIG. 1.

FIG. 4 is a detail view of the actuator and spout employed in the embodiment of FIGS. 1 and 2 as rotated through ninety degrees.

FIG. 5 is a detail view of a portion of the structure shown in FIG. 1

FIG. 6 is a view taken along line 6-6 in FIG. 5.

DETAILED DESCRIPTION OF PREFERRED EMBODIMENTS

FIGS. 1-6 disclose an aerosol dispenser employing a vertical container 10 filled with a pressurized liquid. The container has an upper end 12 having a circular periphery 14. An actuator 16 for liquid ejection extends upward from upper end of the container. The actuator has a liquid introduction or stem 18 connected to a valve connecting the contents of the container to an injection spout which terminates in a side disposed nozzle. The actuator when pressed downward ejects a jet flow of liquid from the nozzle.

As shown in FIG. 4, the nozzle extends outward from the body of the spout and has a conical shape 20.

Apparatus is employed to prevent the residual film after termination of the jet flow from remaining on the nozzle and clogging it. The apparatus includes a first vertical cap 24, which detachably extends downward to engage the periphery 12 of the upper end 16 of the container and enclosing the actuator. The cap 24 has disposed therein and sealed thereto a second small integral inner cap 26, which slidably engages the nozzle and wipes off residual liquid whenever downward pressure is exerted on cap 24. The inner cap will engage the tip of the nozzle 20.

The cap 24 has two oppositely directed inner projections 28 which engage the periphery 14 and keep the cap in proper position.

The container has an outer periphery 30, which is positioned intermediate, the ends of the container and encloses a flat region known as a well 32. An enlarged vertical hollow overcap 34 is integral with and encloses caps 24 and 26. Cap 34 extends downwardly into the well and bears against the inner surface of well 32. The cap 34 is used for improving the appearance of the dispenser. However, the three caps are molded as one integral plastic member, which has a uniform top surface, which is sufficiently flexible to accommodate the downward pressure exerted to operate the dispenser.

While the invention has been described with particular reference to the drawing and detailed description, the protection sought is to be limited only by the terms of the claims which follow.

What is claimed is:

1. An aerosol dispenser comprising:

a vertical container filled with a pressurized liquid;

an actuator for liquid ejection extending upward from a valve from the upper end of the container, said actuator having a liquid introduction stem connected both to the container and to an injection spout which terminates in a side disposed nozzle, the actuator when pressed downward ejecting a jet flow of liquid from the nozzle; and apparatus for preventing a residual liquid film after termination of the jet flow from remaining on the nozzle and clogging it, said apparatus including a first vertical cap which detachably extends downward to engage the upper end of the container and enclose the actuator, said first cap having disposed therein and sealed thereto a small vertical inner cap which slidably engages the nozzle and wipes off the film whenever downward pressure is applied to the first cap.

2. The dispenser of claim 1 wherein the nozzle extends outward from the body of the spout and has a conical shape.

3. The dispenser of claim 2 wherein the container has an outwardly extending circular periphery and encloses a flat region known as a well.

4. The dispenser of claim 3 further including enlarged vertical hollow overcap which is integral with and encloses the first and second caps and extends downwardly into the well and bears against the inner surface of the container periphery.

5. The dispenser of claim 4 wherein the overcap and first and second caps constitute an integral plastic member.

* * * * *